US005150563A

United States Patent [19]

Hartness

[11] Patent Number: 5,150,563

[45] Date of Patent: Sep. 29, 1992

[54] SQUARE AND/OR ROUND CONTAINER PACKING DEVICE

[75] Inventor: Robert G. Hartness, Greer, S.C.

[73] Assignee: Hartness International, Inc., Greenville, S.C.

[21] Appl. No.: 765,430

[22] Filed: Sep. 25, 1991

[51] Int. Cl.[5] ..... B65B 35/30

[52] U.S. Cl. ..... 53/539; 53/247; 53/248

[58] Field of Search ..... 53/246, 247, 248, 255, 53/260, 263, 539

[56] References Cited

U.S. PATENT DOCUMENTS

| | | | |
|---|---|---|---|
| 3,922,836 | 12/1975 | McGill | 53/248 |
| 4,033,095 | 7/1977 | Wild | 53/248 |
| 4,078,361 | 3/1978 | Hartness et al. | 53/248 X |
| 4,171,603 | 10/1979 | Wiseman | 53/248 |
| 4,207,722 | 6/1980 | Raudat | 53/248 |
| 4,281,501 | 8/1981 | Rydell | 53/248 |
| 4,608,804 | 9/1986 | Wild | 53/255 X |
| 4,744,205 | 5/1988 | Probst | 53/539 |
| 4,833,860 | 5/1989 | Hartness | 53/539 X |
| 4,835,946 | 6/1989 | Hartness et al. | 53/539 |

*Primary Examiner*—John Sipos
*Assistant Examiner*—Daniel B. Moon
*Attorney, Agent, or Firm*—Dority & Manning

[57] ABSTRACT

A carton loading apparatus for loading delicately covered articles into a carton having dividers therein arranged to define spaces for the articles is disclosed. The apparatus utilizes a reciprocal grid structure to transport the articles from a separation station to a loading station. The grid structure includes guide surfaces which guide the articles away from the sharp edges of the grid structure as the articles are moved therein thereby preventing damage to the articles. Other guide elements associated with the grid guide the articles in moving from the grid to the carton so as to avoid the sharp edges of the dividers.

8 Claims, 5 Drawing Sheets

Fig. 2.
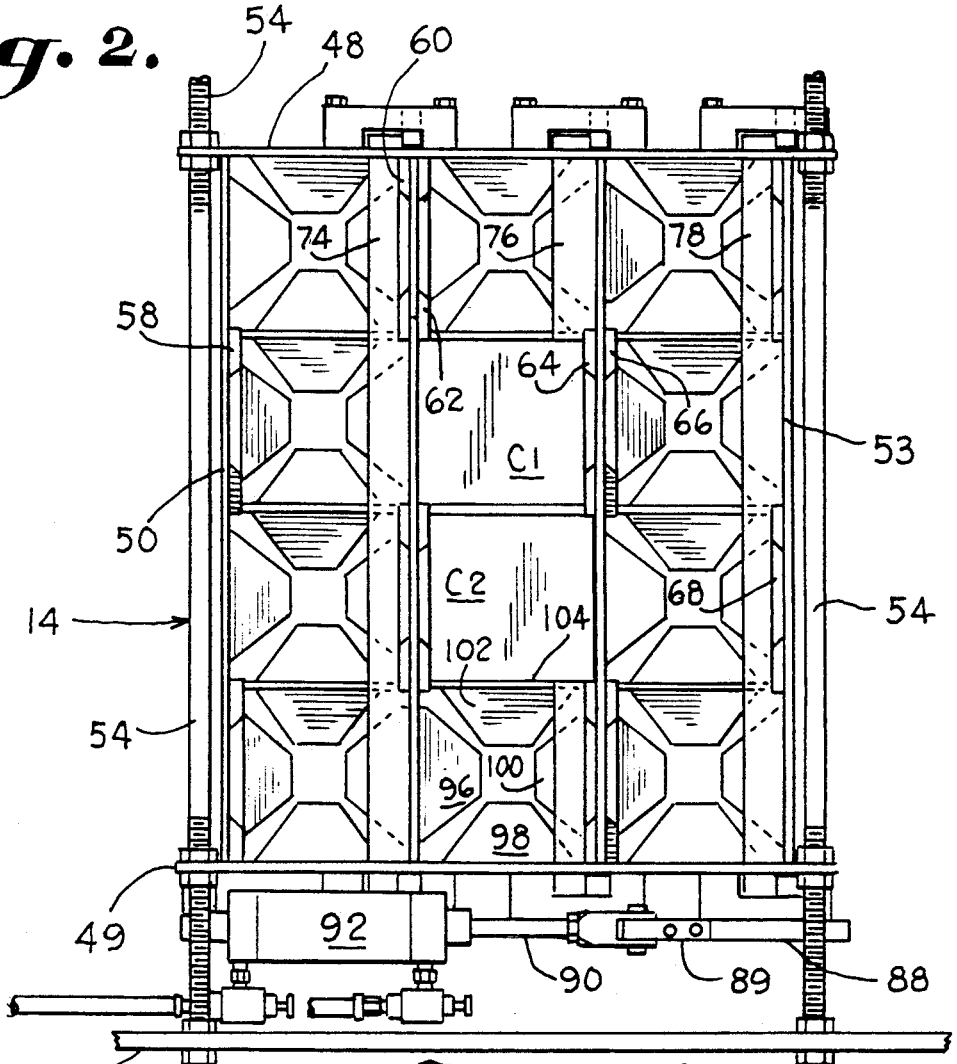
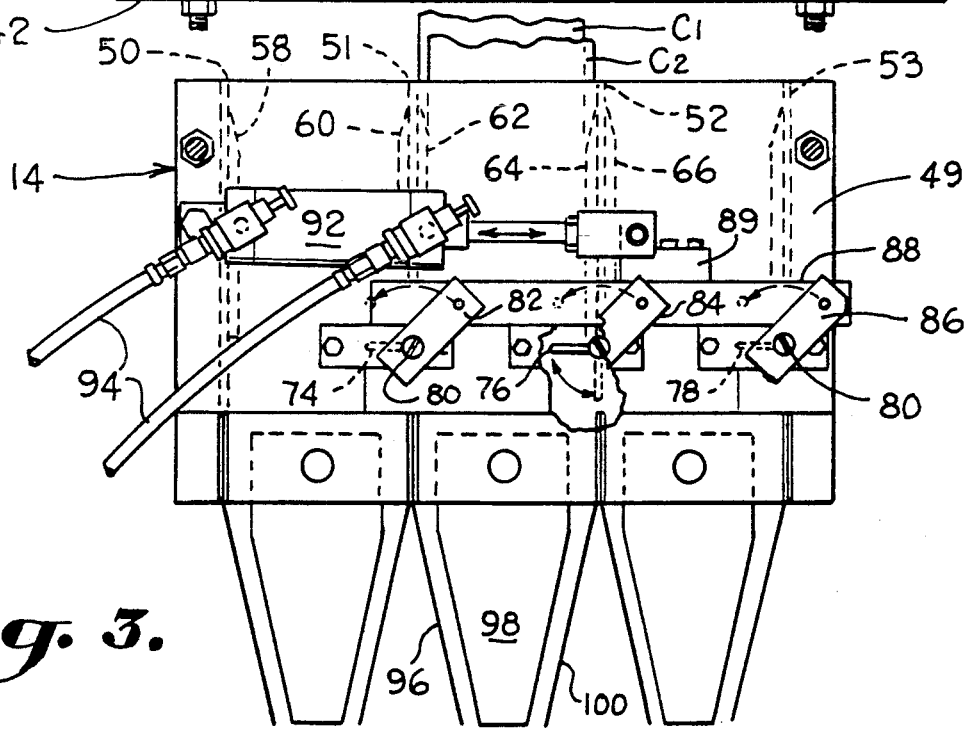
Fig. 3.

SQUARE AND/OR ROUND CONTAINER PACKING DEVICE

BACKGROUND OF THE INVENTION

The present invention relates to packing devices for loading articles into a carton for handling and distribution and more particularly to a packing device particularly devised for packing square containers or round articles having fragile labels applied thereto.

In recent years, there has been a substantial increase in the marketing of bottles containing beverages utilizing a square container for the individual bottles as gift items during seasonal holidays, celebrations and during other notable occurrences wherein decorative square containers may be utilized to enhance the occasions. These square containers, or the individual bottles, are placed in a carton adapted to contain anywhere from 4 to 12, or more containers. The individual containers themselves are artistically decorated and generally are endowed with delicate or fragile wrappings, labels, ribbons and/or lettering indicative of the occasion or season involved.

The carton into which the individual containers are placed are supplied with corrugated dividers arranged so as to form square spaces for the reception of the individual containers. Because of the delicate nature of the containers, bottling personnel must be assigned to place the containers in the cartons manually so as not to destroy or injure the decorations, etc. attended to each of the containers. Perhaps the main cause for any damage or injury occurring would be the result of the containers engaging and rubbing against the upper edges of the dividers as the individual containers are slid into the spaces defined by the dividers. It will be apparent then that packing such square containers in cartons manually is rather time-consuming, and certainly, from a cost standpoint, the use of personnel to manually load the cartons is prohibitive. In more recent years, as previously stated, the use of such containers for complimentary bottles has grown significantly, thus, taxing the personnel requirements needed by the bottling industry. The results of these manual requirements and time consumption has directly affected the marketing price for the bottles.

The present invention has been devised in order to obviate the problems and disadvantages enumerated above. An arrangement has been devised for automatically placing the square container carrying bottles along a plurality of paths until a proper number of containers have been selected for the size of the carton to be utilized. The proper number of containers are then directed into a frame structure and held momentarily therein before permitting the movement of the containers into the carton in precise paths so that the dividers placed in the carton do not come in contact with the labels or the square containers. The frame structure is constructed with suitable guiding elements in designated positions to engage each of the containers as they are moved therein to reposition the same without damage thereto or to labels applied thereto for the proper entry into the areas designated by the dividers in the carton.

Therefore, it is the principal object of the present invention to load cartons with a plurality of delicate bottled containers without damage to the containers.

Another object of the present invention is to arrange a packing device wherein delicately decorated bottles or containers therefor may be automatically positioned within a carton without interfering with decorative material arranged on the bottles, or the individual containers therefor.

These and other advantages and objects will become apparent after reading the following description taken in conjunction with the accompanying drawings wherein:

BRIEF DESCRIPTION OF THE DRAWINGS

FIG. 2 is a plan view of a locating frame structure for the square containers;

FIG. 3 is a side elevational view of the locating frame structure;

DESCRIPTION OF A PREFERRED EMBODIMENT

Figure 1:
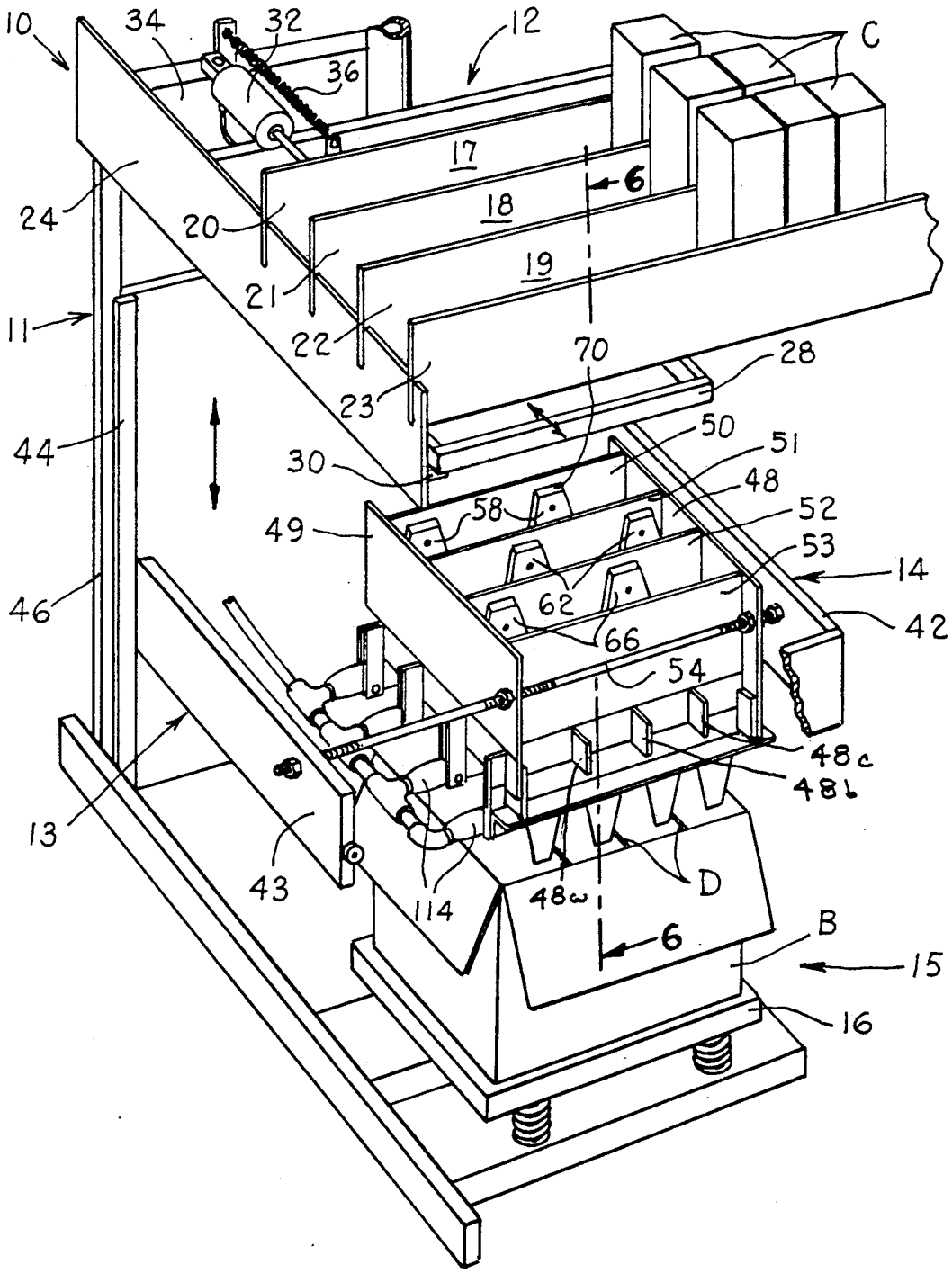
FIG. 1 is an isometric view of a packing device for square containers arranged in accordance with the present invention.

In FIG. 1, a packing or loading apparatus is shown generally indicated by the reference numeral 10 as including a frame structure 11, a container separating device 12, a transport mechanism 13 arranged for reciprocally moving a container-receiving grid structure 14 and a carton loading station 15 having a platform 16. The apparatus 10 is devised to receive square containers C, each containing a bottle of beverage therein, from a suitable continuously actuable conveyor system (not shown). When a proper number of containers C have been received, the grid structure 14 is arranged to receive the containers therein and to position the same in proper alignment before being moved downwardly into cooperative engagement with the carton B positioned immediately below the transport 13.

Figure 6:
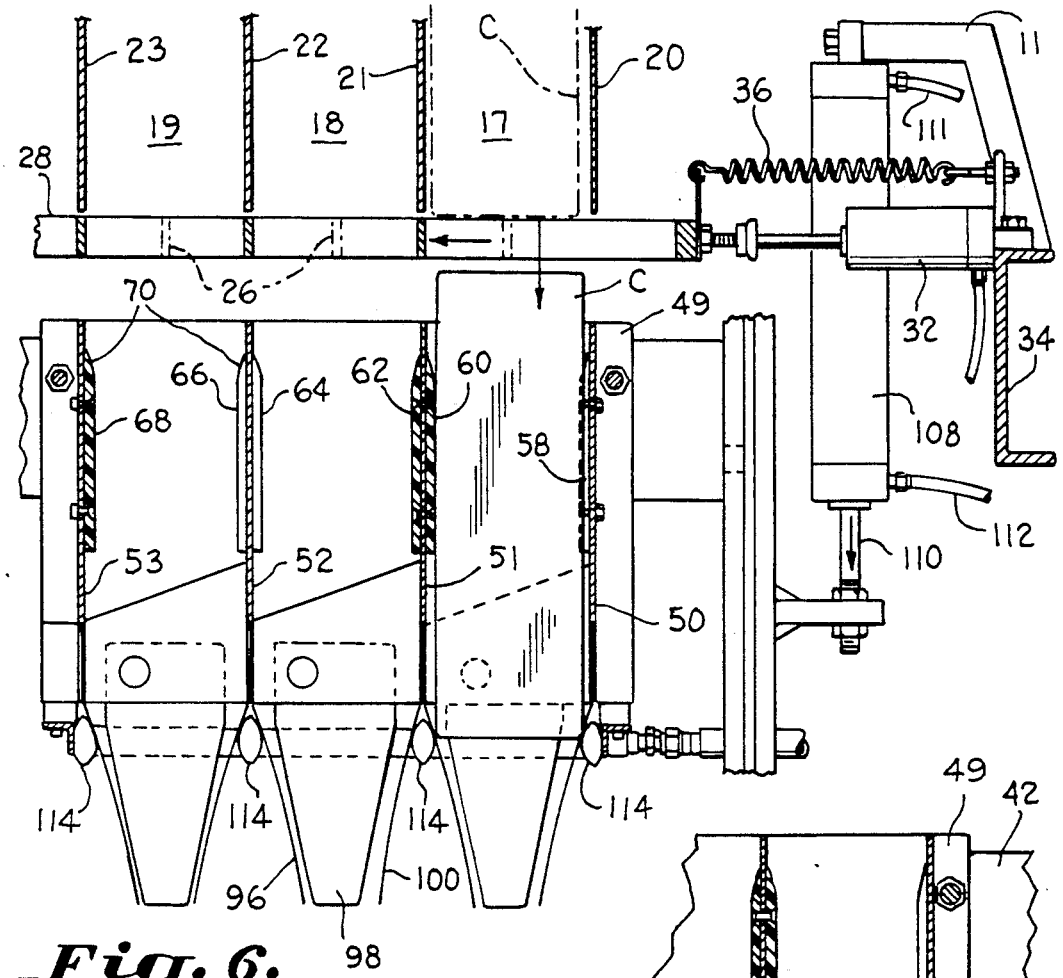
FIG. 6 is cross-sectional view of the frame structure taken along line 6—6 in FIG. 1.
Figure 7:
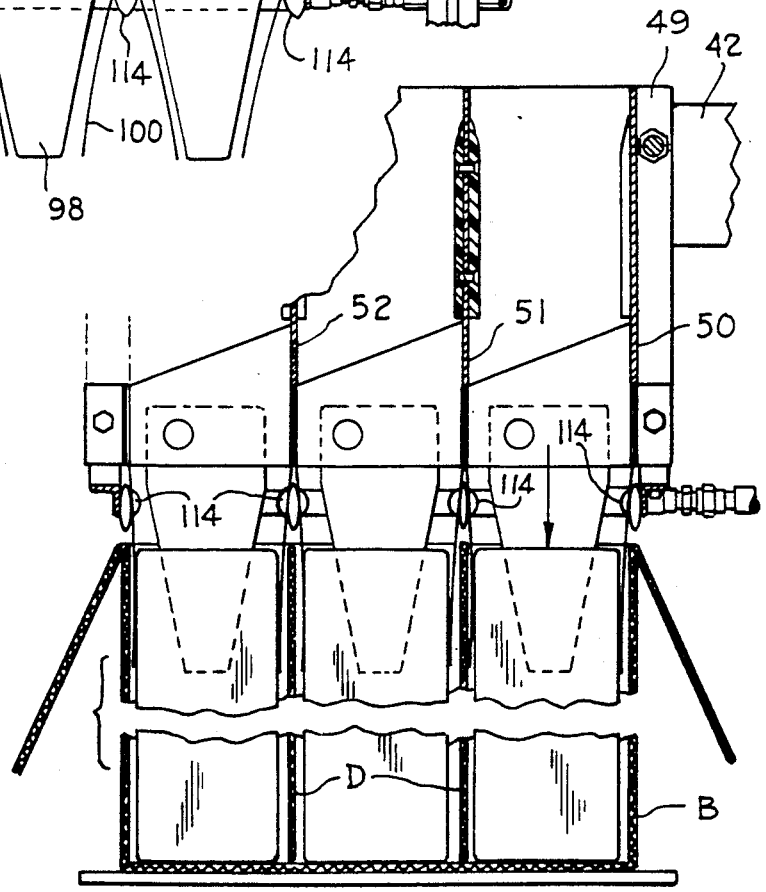
FIG. 7 is a fragmentary view partially in cross-section of the lower portion of the frame structure positioned within a carton arranged to receive the square containers.

As the containers C are moved into the separating device 12, they are selectively directed to each of three paths 17, 18 and 19 alternately. The paths are defined and separated by plates 20, 21, 22, 23 arranged in parallel on a support structure 24, as shown in FIGS. 1 and 6. The support 24 is open at the bottom between the plates 20, 21, 22 and 23 but the containers C are prevented from falling therethrough by structural elements 26 mounted in parallel on a movable restraining gate 28 positioned below the support 24. The gate 28 is supported for horizontal sliding movement reciprocally on shoulders 30 mounted inwardly on each of the sides of the support 24.

Very high speed movement of the gate 28 is provided by a hydraulic ram 32 mounted on a rear panel 34 of the frame structure 11. Upon actuation of the ram 32, the gate 28 is moved to the left, as viewed in FIG. 6, thereby permitting the containers C which previously had been moved into the lanes 17, 18, 19 to fall vertically and into the grid structure 14, as will be described below. The gate 28 is returned to the position shown in FIG. 6 by a coil spring 36 held in compression between the panel 34 and the gate 28 for returning the same immediately prior to the movement of another run of containers C into the separating mechanism 12.

Figure 4:
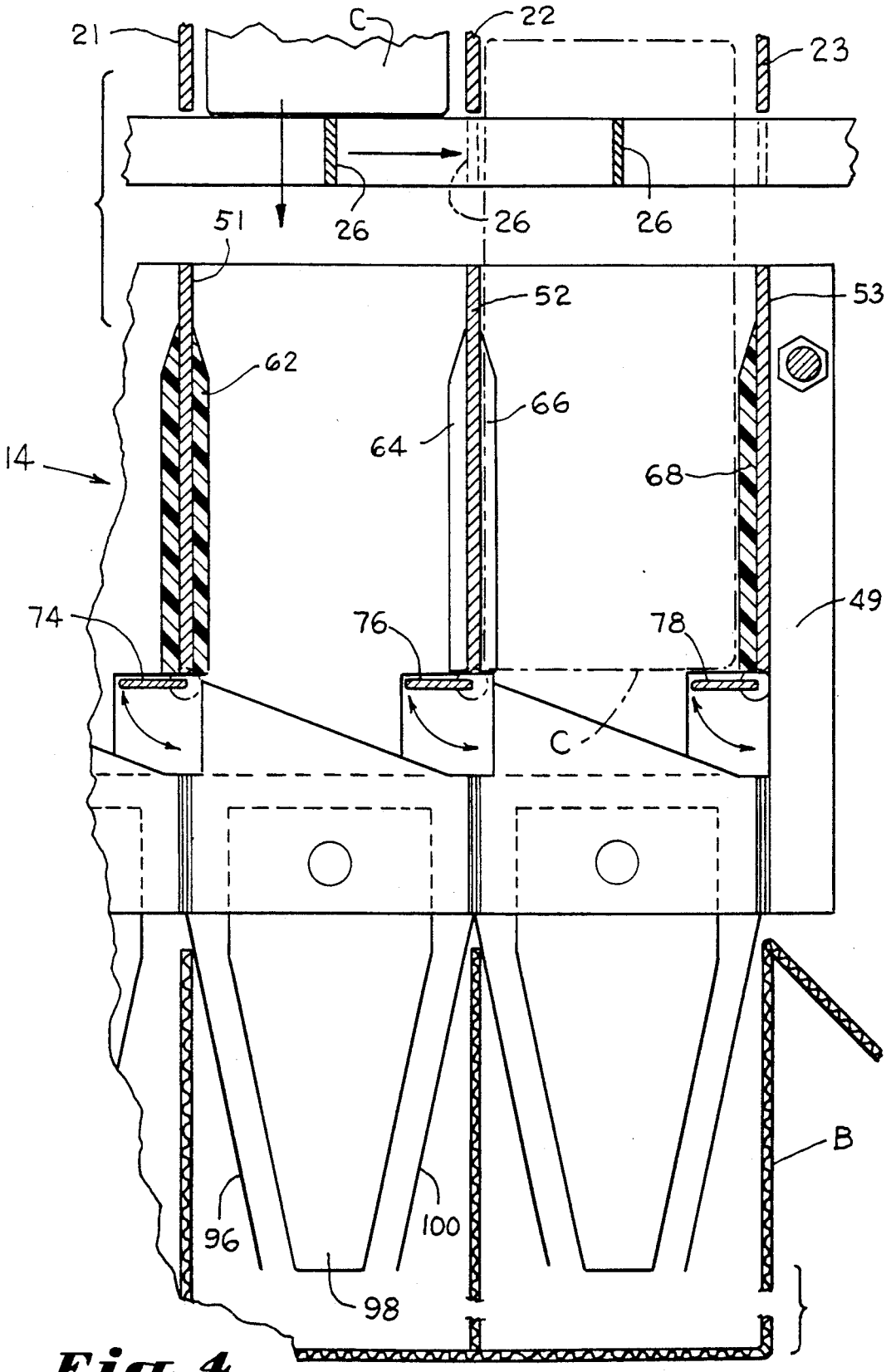
FIG. 4 is a fragmentary view of a detail within the locating frame structure of FIG. 3.
Figure 5:
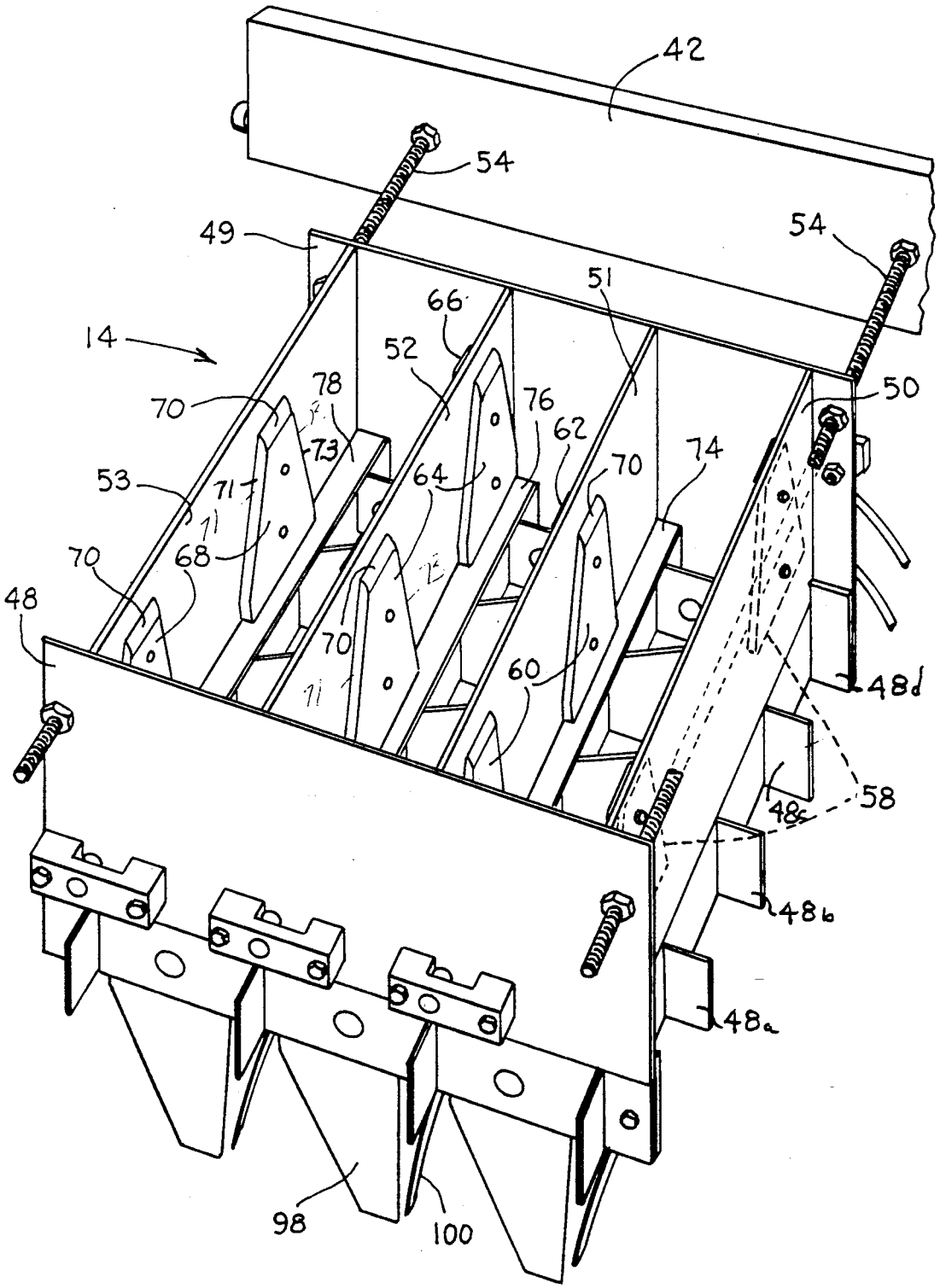
FIG. 5 is an isometric view of the locating frame structure.

During movement of the elements 26, as viewed in FIG. 4, each element is moved a distance equal to approximately half the width of the lanes 17, 18, 19 and assume a position directly below the respective plates 20, 21, 22, 23 so that the sides of the containers C are prevented from engaging the elements 26 as the containers are dropped by gravity into the grid structure 14. Actuation of the ram 32 is such that the structural elements 26 are moved very quickly so as to insure that damage is not inflicted upon the containers C.

The transport 13 supports the grid structure 14 within a frame 42, 43 held in cantilever fashion upon side rails 44 mounted on the vertical support members 46 of the frame structure 11.

The grid structure 14 comprises end plates 48, 49 and four parallel arranged, spaced-apart plates 50, 51, 52, 53 connected at their ends to the end plates 48, 49. The plates 50, 51, 52, 53 are positioned immediately below the lane defining plates 20, 21, 22, 23, respectively, as shown in FIG. 6, and therefore are adapted to receive and hold the containers C when vertically released from the separating mechanism 12. Suitable elongated screws 54 mounted on the side frames 42, 43 and extending through suitable apertures formed in the end plates 48, 49 serve to support the grid structure 14 below the mechanism 12.

Mounted on the interior surface of the grid plate 50 is a pair of trapezoidally shaped bearing blocks 58 arranged along and in spaced relationship. On the opposing surface of the grid plate 51 are similarly shaped bearing blocks 60 arranged along and in spaced relationship but being opposite the spaces left by the positioning of the blocks 58 on the plate 50. Similarly, the other side of the grid plate 51 supports bearing blocks 62 in spaced relationship and being opposed to the spaces left by similar bearing blocks 64 secured to the opposite side of the grid plate 52. On the opposite side of the plate 52, a pair of bearing blocks 66 are secured in spaced relationship opposite the spaces left by similar blocks 68 mounted along on the inside surface of the grid plate 53.

As shown in FIGS. 2 and 3, pairs of blocks 58, 62 and 66 are offset relative to the pairs of blocks 60, 64 and 68, respectively, whereby each of the containers C, after being received into the grid structure 14 is positioned against one of the blocks. Each of the blocks is tapered or beveled along its upper edge 70 whereby during the descent of a container associated therewith, the bottom ends of the sides of the containers engage the tapered edges and are cammed slightly away from the upper edges of the plates 50, 51, 52, 53. The tapered edges 70 are close to the upper edges of the grid plates 50, 51, 52, 53 so that they are immediately effective to guide a container away from the upper edges of the plates thereby eliminating any damage to the wrappings and labels adorning the containers.

With this arrangement, the containers within a lane defined by the opposing grid plates 50, 51, 52, 53 will be staggered a distance equal to the thickness of a bearing block. For example, as shown in FIGS. 2 and 3, the container $C_1$ is slightly offset relative to the next in-line container $C_2$. When all of the containers have been received in the grid 14, in the manner described, they will occupy aligned predetermined positions preparatory to being carefully loaded into a carton B.

The side edges 71 and 73 of the trapezoidally shaped bearing blocks 58, 60, 64 and 68 also engage the bottoms of the square shaped cartons or bottles to guide the cartons over the upper edge of the spaced divider plates 48*a*, 48*b*, 48*c*, and 48*d*. The lower edge of the side edges 71 and 73 extend slightly over the upper surface of the spaced divider plates 48*a*, 48*b*, 48*c* and 48*d* respectively so as to guide the bottom of the carton or bottle over the upper edges into alignment with the sockets carried in the carton.

When the containers C are dropped by gravity into the grid structure 14 upon movement of the gate 28, they are arrested against further movement by pivotally actuable gates 74, 76, 78, each being arranged below one of the lines defined by the plates 50, 51, 52, 53. As shown in FIG. 4, the gates 74, 76, 78 are in their gating position whereby the containers will be held within the grid 14. Pivotal downward movement is imparted to the gates, secured to hinge pins 80 pivotally mounted on the grid 14, by levers 82, 84, 86, each having one end connected to the respective hinge pin 80 and their ends to a slidable actuator 88. The actuator 88 is connected by way of blocks 89 to the piston rod 90 of a hydraulic ram 92 mounted on the grid structure 14. Suitable hydraulic lines 94 serve to actuate the ram 92 from a source of pressure (not shown) after the containers C have been dropped into the grid structure from the separating mechanism 12. Normally, the gates 74, 76, 78 are in the positions shown in FIGS. 3 and 4 for momentarily holding the containers C within the grid. Upon operation of a control signal from the system controller, the ram 92 is actuated to rotate the gates downwardly for permitting the continued free fall of the containers.

The lower end of the grid structure 14 is provided with sets of guide elements or fingers, a set for each container C, arranged to guide the containers into the spaces defined by dividers D, and the sides of the carton B with the dividers. In the interest of simplicity, only one set of guide elements or fingers will be described. However, it will be understood that one set is associated with each container and that same will be directly positioned below its associated container.

A set of guide elements comprising four fingers 96, 98, 100, 102 made from slightly stiff, flat, flexible materials such as tempered steel are arranged to resemble the sides of a square. The finger 96 depends from and is secured to the grid plate 51 while the opposing finger 100 is secured to the plate 52. The finger 98 is secured to the lower edge of the end plate 49 and the opposing finger 102 is secured to a parallel oriented member 104. The fingers 96, 98, 100, 102 are bent slightly inwardly so that the opposing lower ends define a smaller space than the upper space defined by the supporting connections for the fingers. With this arrangement, as a container C is lowered through the set of fingers, the same will flex outwardly equally thereby insuring accurate positioning of the container.

Vertically reciprocal movement of the grid structure 14 is provided by a double-acting hydraulic ram 108 having its cylinder secured at one end to the frame structure 11 of the packing apparatus. The piston 110 for the ram 108 is secured to and between the end plates 49, 50 for the grid structure and is actuable, upon pressurization of the ram 108 in one direction, to move the grid with containers C positioned therein downwardly to deposit the same into the carton B, and actuable in the reverse upward direction to return the grid to its loading position. Suitable hoses 111, 112 are connected to the ram 108 from a source of hydraulic pressure (not shown) for actuating the ram alternately in both directions.

During downward movement of the grid structure 14 with containers C positioned therein, the containers are momentarily held therein by an inflatable system having air tubes 114 positioned below and along each of the grid plates 50, 51, 52, 53, as shown in FIG. 6. The air tubes 114 are positioned against the adjacent guide finger 96 and 100 for each set of such fingers and when inflated, serve to prevent flexing of the fingers 96, 100. Upon this occurrence, the containers C within the grid structure are held immobile until the grid is lowered to position the guide fingers within the spaces defined by the dividers D. When the fingers are so positioned, the air tubes are immediately deflated to permit the downward guided movement of the containers C into the carton.

In operation, containers C are conveyed seriatim to the separating apparatus 12 whereat they are directed and separated into the three lanes 17, 18, 19. While any number of lanes may be utilized and any number of containers directed into each lane, for purposes of description, three lanes and four containers in each lane have been chosen. When the proper number of containers have been positioned in the apparatus 12 and with the grid structure in its normal uppermost position, the gates 28 are moved out from under the containers thereby permitting their downward movement into the grid structure whereby they become properly aligned for the eventual placement in the carton B. In moving into the grid structure, the bottoms of the containers engage guide elements in the form of beveled surfaces which divert the falling containers away from the sharp edges of the grid structure thereby protecting the surfaces of the containers from damage thereby.

Prior to the release of the containers from the apparatus 12, the air tubes 114 would have been inflated. As the containers move into the grid 14, further movement is arrested by the action of the inflated air tubes against the fingers 96, 100. When the containers are in their aligned position within the grid, the same is lowered to position each of the sets of grid fingers 96, 98, 100, 102 into its respective space within the carton B and air pressure within the tubes 114 is quickly released. This deflation of the tube permits the continued downward movement of the containers C into the carton. In this movement, each of the containers is guided by a set of guide fingers which insure that the sides of the containers do not engage the upper edges of the dividers D thereby eliminating the possibility of damaging delicate wrappings and labels.

From the foregoing, it will be appreciated that the present invention permits the automatic and high speed loading of delicately adorned containers within a carton having spaces defined by dividers without contacting and damaging items of adornment such as delicate wrappings, ribbons, labels, etc. While the invention has been described and illustrated utilizing a vertically moving grid structure movable between a station for separating containers to be loaded and a carton loading station, it will be understood that the invention is equally applicable to an arrangement whereby the grid structure may be moved horizontally or at an acute angle relative to the vertical. The invention is also applicable to an arrangement whereby the grid structure remains stationary and the platform holding the carton to-be-loaded is moved to receive the articles being loaded.

For illustrative purposes, square containers have been illustrated and these as wrappings for beverages suitable as gift items during seasonal holidays. It will be understood that the present invention is applicable to round containers and to round or square bottles not provided with additional containers. The containers or bottles may be of any size or used for any purpose. For example, bottles loaded in a carton in accordance with the present invention may contain drugs and medicines, or food products, liquid or granular.

In a modified form of the invention the grid 14 remains stationary and when the gate is activated to release the containers the containers drop directly through the grid 14 into the sockets provided in the carton B. The air tubes 114 are not utilized. The blocks 58, 60, 62, 64 and 68 guide the containers to the appropriate sockets.

While preferred embodiments of the various aspects of the invention have been described using specific terms and arrangements, such descriptions are for illustrative purposes only, and it is to be understood that changes and variations may be made without departing from the scope of the following claims. For example, while the present invention is described and illustrated as having hydraulic rams for the various operating structure, it will be understood that these devices were selected only for illustrative purposes, and that pneumatic cylinder/piston units, the preferred operating devices, may be utilized in their place.

What is claimed is:

1. An apparatus for loading articles having a substantially rectangular cross-sectional area into a carton having dividers positioned therein to define sockets for each of the articles, comprising:

a loading grid for receiving a charge of articles to be deposited into said carton;

means for dropping said charge of articles through said loading grid;

a carton loading station for supporting said carton thereon during a loading operation;

a guiding grid interposed between said loading grid and said carton;

said guiding grid including:

(a) a plurality of parallel spaced apart elongated plates, said plates defining lanes for said rectangular cross-sectional articles dropped from said loading grid, (b) trapezoidal shaped guide blocks affixed on said elongated plates within said lanes, (c) an upper tapered guiding edge provided on said guide blocks, said tapered guiding edge for canting said articles into said lanes as said articles are dropped through said loading grid, and (d) inclined side edges provided on the sides of said guide blocks, and said guide blocks disposed along said elongated plates within said lanes oppositely facing each other in a staggered manner so that said articles being dropped from said loading grid into said lanes are guided into predetermined positions within said lanes by said inclined edges.

2. The apparatus as set forth in claim 1 further comprising:

spaced apart parallel divider plates carried below said guiding grid and disposed transverse to said elongated plates through which said articles pass as they are being dropped into said sockets of said cartons, and whereby said inclined side edges of said trapezoidal shaped guide blocks overlap upper edges of said spaced apart divider plates for preventing said articles from contacting said upper edges as said articles are dropped into said sockets provided in said cartons.

3. The apparatus as set forth in claim 2 further comprising:

means carried directly below said guiding grid for arresting said articles in said guiding grid after they are dropped through said loading grid;

means for lowering said guiding grid down over said carton; and means for releasing said arrested articles causing said articles to drop into said carton.

4. The apparatus as set forth in claim 1 wherein said articles being loaded into cartons are bottles having a rectangular shaped cross section.

5. The apparatus as set forth in claim 1 wherein said articles being loaded into cartons are boxes having a rectangular shaped cross section.

6. A guiding grid for an article loading machine for guiding articles having a substantially rectangular shaped cross-section dropped from a charge loading grid into a carton having sockets provided therein, said guiding grid comprising:

a plurality of parallel spaced grid plates, a plurality of parallel spaced divider plates positioned transverse to and below said grid plates so that said grid plates and said divider plates define rectangularly shaped openings of a cross-section slightly greater than the cross-section of said articles;

a plurality of spaced guide blocks affixed to said grid plates in a staggered oppositely facing manner with one said guide block being positioned above each said opening defined by said grid plates and said divider plates; and inclined surfaces provided on the top and sides of said guide blocks for contacting and directing said articles to a predetermined position in each of said openings as said articles are dropped through said openings, said inclined surfaces preventing said articles from contacting said divider plates.

7. The guiding grid as set forth in claim 6 wherein said guide blocks have a trapezoidal configuration defined by an upper edge, side edges and a lower edge, whereby a lower portion of said side edges extend over upper surfaces of said divider plates for guiding articles through said openings without contacting said upper surfaces of said divider plates.

8. An apparatus for preparing a charge of articles which have a substantially rectangular cross-sectional area for loading into a carton at predetermined positions therein, said apparatus comprising:

a set of parallel spaced apart grid plates, said grid plates defining lanes for said articles received from a loading grid;

a set of parallel spaced apart divider plates disposed perpendicular to and below said grid plates, said divider plates cooperating with said grid plates to define rectangular shaped passages through which said articles pass when being loaded into said carton, a plurality of guiding blocks secured to said grid plate, each said guiding block having a tapered upper edge and inclined side edges, said guiding blocks disposed along said grid plates within said lanes in an oppositely facing staggered fashion so that each said article dropping into said lanes is first canted into said lane by contacting said tapered upper edge of one said guiding block and guided into a predetermined position within said lane by said inclined side edges of two adjacent and oppositely facing said guiding blocks;

means for holding said articles within position in said lanes above said divider plates; and means for releasing said articles from said holding means so that articles may drop through and between said divider plates and into predetermined positions within said carton, said inclined side edges of said guiding blocks each extending over the tops of said divider plates so that said articles do not contact said divider plates when being positioned within said lanes and when dropping through said divider plates into said carton.

* * * * *